US008323479B2

(12) United States Patent
Khan

(10) Patent No.: US 8,323,479 B2
(45) Date of Patent: Dec. 4, 2012

(54) CONVERTING HEAVY SOUR CRUDE OIL/EMULSION TO LIGHTER CRUDE OIL USING CAVITATIONS AND FILTRATION BASED SYSTEMS

(75) Inventor: M. Rashid Khan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 13/352,111

(22) Filed: Jan. 17, 2012

(65) Prior Publication Data

US 2012/0118792 A1 May 17, 2012

Related U.S. Application Data

(63) Continuation of application No. 12/273,636, filed on Nov. 19, 2008.

(51) Int. Cl.
*C10G 45/06* (2006.01)
*C10G 45/08* (2006.01)
*C10G 45/10* (2006.01)

(52) U.S. Cl. ..... 208/216 R; 208/210; 208/215; 208/217

(58) Field of Classification Search ..... None
See application file for complete search history.

(56) References Cited

U.S. PATENT DOCUMENTS

| | | | | |
|---|---|---|---|---|
| 2,381,659 | A * | 8/1945 | Frey | 502/25 |
| 3,616,375 | A | 10/1971 | Inoue | |
| 4,391,608 | A | 7/1983 | Dondelewski | |
| 5,779,999 | A | 7/1998 | Laslo | |
| 5,824,214 | A * | 10/1998 | Paul et al. | 208/107 |
| 5,928,615 | A | 7/1999 | Strock et al. | |
| 6,402,939 | B1 | 6/2002 | Yen et al. | |
| 6,555,009 | B2 * | 4/2003 | Varadaraj | 210/708 |
| 6,814,942 | B2 | 11/2004 | Shinoda et al. | |
| 7,259,288 | B2 | 8/2007 | Khan | |
| 7,578,928 | B2 * | 8/2009 | Lott et al. | 208/108 |
| 7,871,512 | B2 * | 1/2011 | Cullen | 208/196 |
| 2003/0102255 | A1 * | 6/2003 | Mahajan | 208/243 |
| 2006/0231462 | A1 | 10/2006 | Johnson | |
| 2006/0254956 | A1 | 11/2006 | Khan | |
| 2008/0173571 | A1 | 7/2008 | Yen et al. | |

FOREIGN PATENT DOCUMENTS

EP 1452576 A2 9/2004

OTHER PUBLICATIONS

M. Rashid Khan; David J Patmore; "Heavy Oil Upgrading Processes"; book chapter in "Chemistry and Refining of Petroleum", 1998, pp. 149-171, edited by J. Speight, Taylor & Francis, published in U.S.

M. Rashid Khan, "Rheological Properties of Heavy Oils and Heavy Oil Emulsions"; Energy Sources, 1996, 18:385-391, Taylor & Francis, published in London, U.K.

International Search Report for PCT/US09/64690 dated Mar. 1, 2010.

* cited by examiner

*Primary Examiner* — Randy Boyer
(74) *Attorney, Agent, or Firm* — Bracewell & Giuliani LLP

(57) ABSTRACT

A process for converting heavy sulfur-containing crude oil into lighter crude oil with lower sulfur content and lower molecular weight is provided. The process is a low-temperature process using controlled cavitation.

22 Claims, 7 Drawing Sheets

CONVERTING HEAVY SOUR CRUDE OIL/EMULSION TO LIGHTER CRUDE OIL USING CAVITATIONS AND FILTRATION BASED SYSTEMS

RELATED APPLICATION

This patent application is a continuation of U.S. Nonprovisional patent application Ser. No. 12/273,636 filed on Nov. 19, 2008, which is hereby incorporated by reference in its entirety.

TECHNICAL FIELD OF THE INVENTION

The present invention relates to the conversion of heavier sulfur-containing crude oil into lighter crude oil with lower sulfur content and lower molecular weight than the original crude oil.

BACKGROUND OF THE INVENTION

The invention generally relates to a process for treating a heavy hydrocarbon crude oil, also referred to herein as "crude oil." More particularly, the process described herein is directed to upgrading a heavy hydrocarbon crude oil feedstock by a hydroprocessing catalyst assisted hydrotreatment. Although the term hydrocracking is often applied to these types of processes, the term hydroconversion (or hydroprocessing or hydrotreatment) will be used herein to avoid confusion with conventional gas oil hydrocracking.

Heavy crude oils are composed chemically of a very broad range of molecules differing widely in molecular weight (MW) and chemical properties. In addition, heavy crude oils from different formations and locations around the world have different characteristics. Because of the large number of variable characteristics of heavy crude oil around the world, it is difficult to define heavy crude oils simply in terms of individual molecular components. Instead, various separation procedures are used to break down the feed into a number of smaller fractions that are more consistently identifiable. One such technique involves separation into solubility classes using solvents of varying polarity and further separation using column chromatography. These fractions can then be further characterized in terms of an average structure by nuclear magnetic resonance (NMR) or other analytical technique known to persons skilled in the art.

Despite the fact that heavy crude oils range widely in their composition and physical and chemical properties, they are typically characterized by having a relatively high viscosity, high boiling point, high Conradson carbon residue, low API gravity (generally lower than 25), and high concentration of sulfur, nitrogen, and metallic impurities. Additionally, the hydrogen to carbon ratio of heavy crude oils is lower than desirable. Further, much of the crude oil around the world also contains relatively high concentration of sulfur. As used herein, the term crude oil, or heavy crude oil, is understood to include heavy hydrocarbon crude oil, tar sands, bitumen, and residual oils, i.e., bottom of the barrel or vacuum bottom oils.

During the last few decades, environmental and economical considerations have required the development of processes to remove heteroatom such as, for example, sulfur, nitrogen, oxygen, and metallic impurities, from the heavy hydrocarbon crude oil feedstocks, as well as to convert the heavy hydrocarbon crude oil feedstocks to lower their boiling points. Such processes generally subject the heavy hydrocarbon crude oils or their fractions to thermal cracking or hydrocracking to convert the fractions having higher boiling points to fractions having lower boiling points, optionally followed by hydrotreating to remove the heteroatoms.

Petroleum hydrocarbons are subjected to a variety of physical and chemical processes to produce higher value products. For example, in a gas-oil separator (GOSP), crude is processed to remove water and other contaminants, such as salt, to achieve BS&W requirements. BS&W requirements are a measure of bottom sediment and water, usually expressed as a percentage by weight.

Refining and other high temperature treatments are well known in the art. Technologies for upgrading heavy crude oil, including bitumen and residual oils, to give lighter and more useful oils and hydrocarbons can be broadly divided into two types of processes: carbon rejection processes and hydrogen addition processes. Both of these processes employ high temperatures (usually greater than 400° C.) to "crack" the long chains or branches of the hydrocarbons that make up the heavy hydrocarbon crude oil. In the carbon rejection process, the heavy hydrocarbon crude oil is converted to lighter oils and coke. In some carbon rejection processes, the coke is used elsewhere in the refinery to provide heat or fuel for other processes.

Hydrogen addition processes involve reacting heavy crude oils with an external source of hydrogen resulting in an overall increase in hydrogen to carbon ratio. One benefit of hydrogen addition processes compared to carbon rejection processes, is that in the hydrogen addition process, formation of coke is prevented through the addition of high pressure hydrogen. Examples of hydrogen addition processes include: catalytic hydroconversion (hydrocracking) using active HDS catalysts; fixed bed catalytic hydroconversion; ebullated catalytic bed hydroconversion; thermal slurry hydroconversion (hydrocracking); hydrovisbreaking; and hydropyrolysis.

While such treatments reach the desired goal of lowering the density of hydrocarbons or separation of desired hydrocarbon fractions, these treatments include several drawbacks including possible undesirable cracking. It is desirous to avoid the negative effects associated with such treatments, while still processing the original hydrocarbon to reduce sulfur content and/or molecular weight of the original crude.

Water Treatment

Traditional refining processes are also sensitive to water contained in crude. Feedstock from the oil field typically contains water. Processed oil that is to be transported by pipeline must generally be free of water to meet pipeline specification. Similarly, processed oil must generally be free of water to be sold. A large portion of the water contained in crude is free water that is not dissolved in hydrocarbon. Often though, the water is highly dispersed in droplets throughout the oil, thus forming an emulsion. Emulsions have varying characteristics with some emulsions being tightly bound such that it is difficult to separate the water phase from the oil phase. The separation of water from oil can be quite costly. Therefore, there is a need for a cost effective method to remove water from petroleum feed. It would be desirable for this cost effective method to efficiently remove trace amounts of water as well as or after achieving gross separation.

Several methods of reducing the viscosity of the petroleum products in order to facilitate extraction of water from the emulsion are known in the art, including heating the petroleum. It has been proposed that a geologic formation can be heated via electrodes deployed in the ground using resistance heating to break the water in situ.

Chemical methods are commonly used to separate water-in oil emulsions and oil-in water emulsions. Conventional demulsification techniques can be very energy and chemical intensive making the process expensive. Furthermore, the demulsification agents may have undesirable effects on the petroleum product, since they are typically hydrophilic surfactants or synthetic/natural flocculants. It is desirable to provide a chemical-free method of breaking emulsions such that the product quality is not deteriorated through the addition of extraneous chemical additives.

Sulfur Removal

Since much of the world's crude oil contains sulfur in quantities that are too high for a finished product, many operations use desulfurization techniques in their processes. Sulfur occurs in many forms in crudes or in light oil, middle oil or other fractions or products. These forms of sulfur can include hydrogen sulfide, organic sulfides, organic disulfides, mercaptans (or thiols), and aromatic ring compounds, such as thiophene, benzothiophene (BT), dibenzothiophene (DBT) (jointly "thiophenic sulfur") and their alkylated homologues. Depending on the boiling point fraction of the oil, the form of the ring sulfur differs. Desulfurization of the 4,6-dialkyl dibenzothiophene present in substituted dibenzothiophenes can be extremely difficult. Of the thiophenic sulfur compounds, the alkyl substituted dibenzothiophenes are particularly resistant to hydrodesulfurization. Conventional hydrodesulfurization methods to remove sulfur from the residual of a distillation column are often carried out at a temperature over 400° C. with hydrogen gas applied to the charge. Catalyst such as cobalt and molybdenum on alumina are used to enhance the reaction, as disclosed in US Publication No. 2006-0254956 A1, which is herein incorporated in its entirety.

Crude oil varies so greatly by nature, with large differences not only in the hydrocarbon mixture but also in other organic compounds containing heteroatoms such as sulfur, oxygen, nitrogen and metals, such as nickel and vanadium, as well. Most crude oil undergoes distillation processes to refine the crude to desired products. It would be desirable to take advantage of resources available at the production field or at shipside to achieve some degree of desulfurization before transporting the crude for distillation processing.

Sulfur compounds are also a consideration in hydroprocessing and hydrotreating. Hydroprocessing refers to the processes in which hydrogen gas is used as part of a conversion of various feedstocks (including aromatics and heavy naphthas) into useful products. Hydroprocessing achieves this outcome through the hydrogenation and the breakup of polynuclear aromatics. Significant portions of these feedstocks are converted through hydrocracking into smaller-sized and more useful product constituents. In conventional hydrotreating processes, the hydrogenation reactions of aromatic compounds play an important role, mostly because heavy residual compounds are normally aromatic in nature. Therefore, the complete or partial saturation of these compounds by hydrogen addition is an important step in their cracking into smaller, more valuable compounds. Conventional heavy oil hydrocracking processes require relatively high temperatures and high pressures, which are often over 410° C. and greater than 1000 psi, respectively. Consequently, processing of the crude under more mild conditions would be desirable.

When a petroleum fraction that contains sulfur is being catalytically cracked, the products of the catalytic cracking usually contain sulfur impurities, which normally require removal through hydrotreating in order to comply with relevant product specifications. Such hydrotreating is done either before or after catalytic cracking. Conventionally, feeds with substantial amounts of sulfur, i.e. more than 500 ppm sulfur, are hydrotreated with conventional hydrotreating catalysts under conventional conditions, thereby changing the form of most of the sulfur in the feed to hydrogen sulfide. The hydrogen sulfide is then removed by amine absorption or related stripping techniques. These techniques, while removing significant amounts of hydrogen sulfide, often leave traces of the most troublesome sulfur compounds, such as thiophenic sulfur, in the hydrocarbon stream. These compounds are less responsive to conversion techniques.

Hydrodesulfurization, also called hydrotreating, can be effective in reducing the level of sulfur to moderate levels, e.g. 500 ppm, without a severe degradation of olefins or other desirable products. The refractory sulfur compound's DBT (dibenzothiophene) can be removed by distillation; however, it requires additional capital expenditure and results in a degraded product, i.e. downgrading a portion of automotive diesel oil to heavy fuel oil. Hydrotreating of any of the sulfur-containing fractions of cracked gasoline causes a reduction in the olefin content. Current sulfur specifications can often be met without excessive octane loss by hydrotreating only the heaviest, most sulfur-rich and olefin-poor portion of the FCC (Fluid Catalytically Cracked) gasoline. A new method would be advantageous that would preserve yield and octane while removing sulfur from the relatively olefinic light and mid-range portions of the FCC gasoline pool.

Furthermore, in order remove sulfur and heavy metals satisfactorily, the catalytic material must be in intimate contact with the crude oil; however, the prior arts have failed to achieve such contact.

Thus, there remains a long felt need for a method of removing sulfur from crude oil feeds that contain sulfur compounds, including thiophenic sulfur compounds, under moderate process conditions while maintaining the characteristics of the feed stream.

Furthermore, crude oil produced from a well is often in the form of an emulsion consisting of oil and water. Therefore, it would be desirable to separate this emulsion into an oil phase and aqueous phase and then remove the sulfur contained within the oil phase, under moderate process conditions while maintaining the characteristics of the feed stream.

SUMMARY OF THE INVENTION

The process of the present invention satisfies these needs. The present invention is directed to a method for reducing the sulfur content of a sulfur-containing crude oil stream under mild conditions. The present invention provides a process in which sulfur is removed from a sulfur-containing crude oil feed stream by contacting the crude oil stream with catalyst under sufficient pressure to force the crude oil/catalyst mixture through a filtration medium to provide a product having reduced sulfur content and catalyst-sulfided particles. The catalyst-sulfided particles are then separated from the product to form a product stream that has a reduced sulfur content, and preserves the yield, chemical composition and motor fuel performance characteristics, e.g., octane, of the feed stream.

Furthermore, the invention can also include a method for recovering oil from a water-in-oil emulsion. In such emulsions, particularly those containing crude oils, the organic acids, asphaltenes, basic nitrogen-containing compounds and solid particles present in the crude oil from an interfacial film at the water/oil interface. The present invention presents a novel and efficient way to break the film and demulsify the emulsion, without the need for demulsifying chemicals, whereby the oil phase is separated and recovered and treated in a cavitation system with catalysts to further enhance its value.

In an embodiment of the present invention, the steps of the process include mixing the crude oil feed with a catalyst in a mixer to produce a dispersion stream, the dispersion stream being characterized by dispersion of particles of the catalyst distributed substantially throughout the crude oil feed. The particles defining a particle size range. In a preferred embodiment, the particle sizes are substantially in nano particle size range. The dispersion stream is fed to a filtration cavitation system having a cavitation reactor and a filter. In one embodiment, a mechanical cavitation system is used to force the dispersion stream under high pressure through the filtration media to upgrade the crude oil.

Cavitation can be introduced in a variety of ways known in the art. A preferred embodiment includes inducing cavitation in the filtration cavitation system by pressuring of the dispersion stream through the filter. In one embodiment, this cavitation is induced with mechanical pumps. An alternate embodiment includes inducing cavitation in the filtration cavitation system using transducers. More than one method can be employed at a similar time. In a preferred embodiment, cavitation is induced by applying cavitation vibration having a frequency in the range of about 1 Hz to about 20 kHz to the dispersion stream.

Cavitating and filtering the dispersion stream is conducted in the presence of hydrogen gas to produce a mixed stream. Cavitation pressure and cavitation temperature are controlled during the cavitating and filtering step such that the cavitation pressure is maintained substantially within a pre-defined pressure range and the cavitation temperature is maintained substantially within a pre-defined temperature range. The preferred pre-defined temperature ranges is about 40° C. to about 250° C., and the pre-defined pressure range is about 100 psi to about 1000 psi. The cavitating and filtering step is performed for a pre-determined residence time sufficient to convert a substantial amount of sulfur in the dispersion stream to catalyst-sulfided particles. In one embodiment, the pre-defined residence time is in the range of about three (3) seconds to about two (2) hours.

The mixed stream is then separated into a spent catalyst stream and a product stream. The spent catalyst stream comprises catalyst-sulfided particles. The product stream being hydrocarbon based and having a substantially reduced sulfur content in comparison with the sulfur content of the crude oil feed. Water, if present, is removed along with the catalyst-sulfided particles.

In another embodiment of the present invention, the product stream can be hydrotreated in the presence of hydrogen gas to produce a hydrotreated-product stream. Preferably, the hydrogen gas is highly pure.

In another embodiment of the invention, the product stream is fed to an equilibrium separator for separating gaseous sulfur products from the product stream to form a usable product, wherein the gaseous sulfur products include hydrogen, hydrogen sulfide and mercaptan. In another preferred embodiment, the product stream is split into a recycle stream and an improved product stream. The recycle stream is returned to mix with the dispersion stream and enter the filtration cavitation system for processing. The recycle stream can be returned at any of a variety of points, including, but not limited to, the mixer, upstream of the mixer or directly into the filtration cavitation system. Additionally, the improved product stream can be fed into the equilibrium separator to remove any gaseous sulfur products.

Alternately, the improved product stream can be subjected to hydrotreating prior to introduction into the equilibrium separator. In an alternate embodiment, the catalyst-sulfided particles can be regenerated to form a reformed catalyst stream, and the reformed catalyst stream can then be recycled back into the process at any point upstream the cavitation reactor.

In an additional embodiment, the process could further include feeding the product stream to a fluid catalytic cracker in order to increase olefins as compared to the product stream. In a further embodiment, the process can further include adding a solvent to the crude oil feed prior to the step of cavitating and filtering the dispersion stream.

Often, the crude oil produced from a well contains water that is highly dispersed in droplets throughout the crude oil, thus forming an emulsion. Additional features of the invention in various embodiments include delivering cavitation energy to a treatment volume that is comprised of an emulsion, the emulsion further comprising a hydrocarbon and a substrate. Furthermore, the treatment volume may be located either above or below ground. Delivering the cavitation energy to the emulsion imparts energy to electrons and molecular bonds between the hydrocarbon and the substrate. The molecular bonds separate as a result, facilitating demulsification of the hydrocarbon from the substrate.

In an additional embodiment of the present invention, the process can include sonicating a water-containing crude oil feed in an energy range sufficient to remove a substantial amount of water dissolved in an oil phase of the water-containing crude oil feed to an aqueous phase in the water-containing crude oil feed. The embodiment further includes removing substantially all of the aqueous phase from the water-containing crude oil feed in order to produce the crude oil feed. In a preferred embodiment, the energy range sufficient to remove a substantial amount of water dissolved in an oil phase of the water-containing crude oil feed to an aqueous phase in the water-containing crude oil feed is in the range of about 20 to about 250 watts/cm$^2$.

In an additional embodiment of the present invention, the process can include subjecting the crude oil feed to sonic energy at a frequency that is in the range of about 400 Hz to about 10 kHz in the presence of a metal hydrogenation catalyst while the crude oil feed is being produced in a production well. Any water contained within the crude oil feed reacts to form hydrogen, which is operable to hydrotreat and upgrade the crude oil feed during production.

In an alternate embodiment wherein there is no water contained within the crude oil feed, hydrotreating and upgrading may still be achieved down hole by contacting the crude oil feed with a chemical compound that is selected from the group consisting of ammonia, hydrazine, formic acid, and combinations thereof, and subjecting the crude oil feed to sonic energy within the range of about 400 Hz to about 10 kHz. The chemical compound contacting the crude oil feed reacts to form hydrogen, and the hydrogen is operable to hydrotreat and upgrade the crude oil feed during production. In a preferred embodiment, the metal hydrogenation catalyst is selected from the group consisting of nickel on zinc dust, platinum on carbon, and palladium on carbon.

In an alternate embodiment of the present invention, the process for upgrading a water-containing crude oil includes sonicating the water-containing crude oil in an energy range sufficient to create an aqueous phase from water in the water-containing crude oil and removing substantially all of the aqueous phase from the water-containing crude oil in order to produce a crude oil feed. The crude oil feed is then mixed with a catalyst in a mixer to produce a dispersion stream. The dispersion stream being characterized by dispersion of particles of the catalyst distributed substantially throughout the crude oil feed, the particles defining a particle size range. The dispersion stream is fed to a filtration cavitation system having a cavitation reactor and a filter, where it is cavitated and filtered in the presence of hydrogen gas, producing a mixed stream. Throughout the cavitation and filtration step, the cavitation pressure and cavitation temperature are controlled such that the cavitation pressure is maintained substantially within a pre-defined pressure range and the cavitation temperature is maintained substantially within a pre-defined temperature range. Furthermore, the cavitation and filtration step are performed during a pre-determined residence time sufficient to reduce a substantial amount of sulfur in the crude oil.

The mixed stream is separated into a spent catalyst stream and a product stream, wherein the spent catalyst stream is made up of at least catalyst-sulfided particles. The product stream is split into a recycle stream and an improved product stream, and the recycle stream is returned to the process to mix with the dispersion stream and enter the filtration cavitation system. The improved product stream is hydrotreated using hydrogen gas to further upgrade the stream and fed into an equilibrium separator to remove gaseous sulfur products yielding a usable product.

The properties of the product created by cavitation irradiation in accordance with this invention are significantly improved. Included among these improved properties are the boiling point range, the API gravity, and the sulfur content. Additionally, free water created in accordance with this invention has a reduced content of sulfur as compared to the crude oil feed.

BRIEF DESCRIPTION OF THE DRAWINGS

So that the manner in which the above-recited features, advantages, and objectives of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE INVENTION

Figure 1:
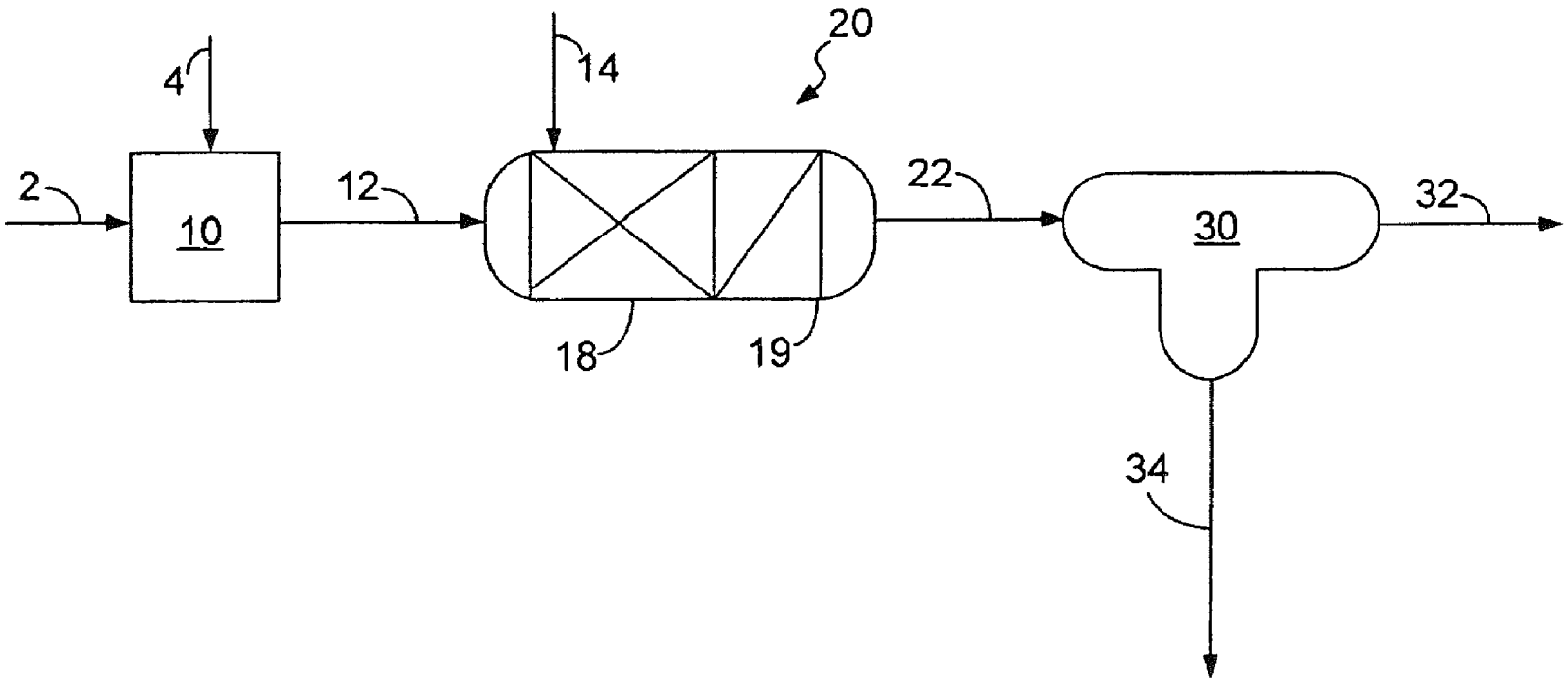
FIG. 1 shows one preferred embodiment of the present invention.

Embodiments of the present invention include processes of producing an upgraded crude oil from a sulfur containing crude oil. As the present invention is disclosed and described, it is to be understood that this invention is not limited to the particular combinations and methods disclosed herein. Accordingly, this disclosure is extended to equivalents of combinations and methods as would be recognized by one of ordinary skill in the arts. It should be understood that terminology employed herein is used for the purpose of describing particular embodiments only and is not intended to be limiting.

Definitions

As used herein, the terms "crude oil" or "hydrocarbon oil" are used to denote any carbonaceous liquid that is derived from petroleum. Included among these liquids are whole crude oil itself and petroleum residuum-based fuel oils including bunker fuels and residual oils.

Crude oil has a wide boiling ranges and sulfur content in different fractions. The present invention is particularly useful for feedstocks that can be described as high boiling point feeds of petroleum origin, since these feeds generally contain higher levels of the aromatic sulfur compounds. The exact cut point selected will depend on the sulfur specification for the gasoline product as well as on the type of sulfur compounds present. Sulfur, which is present in components boiling below 65° C., is mostly in the form of mercaptans and may be removed by extractive type processes. Generally, these feedstocks are: naphtha, gasoil, light cycle oil (LCO), clarified slurry oil (CSO), heavy cycle oil (HCO), thermally cracked stocks, bunker fuels, and vacuum residuum.

As used herein, naphtha includes light naphthas, full naphthas, heavy naphthas or heavy gasoline fractions. Light naphthas typically having a boiling range from about $C_6$ boiling point to about 330° F. Full range naphthas typically having a boiling range of about $C_5$ to about 420° F. Heavier naphtha fractions boiling in the range of about 260° F. to 420° F., or heavy gasoline fractions boiling within the range of about 330 deg to 500° F., preferably about 330° F. to 420° F. Lighter feeds to the process can include a sulfur-containing petroleum fraction, which boils in the gasoline boiling range. The sulfur content of these catalytically or thermally cracked fractions will depend on the sulfur content of the feed to the catalytic or thermal conversion unit as well as on the boiling range of the selected fraction used as the feed in the process. Lighter fractions, for example, will tend to have lower sulfur contents than the higher boiling fractions.

As used herein, gasoil is an uncracked stream, such as gas oil distilled from various petroleum sources, As used herein, LCO, CSO, and HCO are catalytically cracked stocks. Cycle oils from catalytic cracking processes typically have a boiling range of about 400° F. to 750° F. (about 205° C. to 400° C.). Because of the high content of aromatics and poisons such as nitrogen and sulfur found in such cycle oils, they require more severe hydrotreating conditions, which can cause a loss of distillate product.

As used herein, thermally cracked stocks include coker gas oils, visbreaker oils or related materials.

Any of the above that have undergone partial hydrotreatment or any residue or waste material may also be considered as a feedstock. There are more than 600 million barrels of sludge in the ponds and lakes, and the technology taught by the present invention can be applied to recover oil from the clay emulsion that makes up the sludge.

As used herein, bunker fuels are heavy residual oils used as fuel by ships and industry and in large-scale heating installations. No. 6 fuel oil, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and as a power source for large stationary marine engines.

As used herein, vacuum residuum refers to the heaviest fuel oil from the fractional distillation, commonly referred to as "vacuum resid," with a boiling point of 565° C. and above. It is typically used as asphalt and coker feed. The present invention is useful in reducing the sulfur content and lowering the molecular weights of any of these fuels and fuel oils. The boiling range of substituted and non-substituted DBT is 530° F. to 750° F. As the percent hydro-desulfurization increases, the relative percentage of DBT increases.

The term "API gravity" is used herein as it is among those skilled in the art of petroleum and petroleum-derived fuels. In general, the term represents a scale of measurement adopted by the American Petroleum Institute, the values on the scale increasing as specific gravity values decrease.

As used herein, "cavitating" is used to express that the liquid feed stream containing the metal precursors is contacted with cavitation vibrations (or energy). The cavitation vibrations can be in the cavitation frequency range, i.e. 1 Hz to 20 kHz, or the ultracavitation frequency range, i.e. above 20 kHz. The reactor used to impart cavitation vibrations to the crude oil feed stream can utilize conventional means for producing the cavitation vibrations.

As used herein, "nanocatalyst" refers to a catalyst in which the mean average diameter of the catalyst is less than 1 micron and greater than 1 nanometer.

Upgrading by Cavitation

It is believed the cavitations serve many functions. Cavitations mix the crude oil feed and catalyst providing for more intimate contact. The cavitation also causes molecular vibrations, with a resulting high pressure and/or high temperature at the molecular level due to the collapse of bubbles, which then causes the metal bonds in the metal precursor to break, resulting in the formation of the metal particles as described herein.

The cavitations are generally produced by cavitation generators disposed in the liquid feed stream. Conventional electrocavitation transducers may be employed to generate the cavitation vibrations. The cavitation vibrations can be generated using one or more transducers at a single frequency, a range of different selected frequencies or variable frequencies, i.e., chaotic frequencies. The frequency (or frequencies) of the cavitation vibrations can vary depending upon the composition of the feed stream and the specific catalyst precursor(s) used.

In one embodiment, one or more transducers can be used to provide cavitation vibrations at characteristic frequencies corresponding to the resonance frequency of the catalysts metal bonds and/or particular carbon-sulfur bonds of the sulfur compounds present in the feed stream.

Cavitation vibrations in the cavitation reactor may be provided in a variety of ways, such as the use of "piezo-electro crystals." The piezo-electro crystals are generally used to provide higher frequency, i.e., cavitation vibrations, and to transmit a single frequency or a very narrow range of frequencies. A cavitation transducer utilizing a terfenol (composed of 90% iron (Fe), 5% dysprosium (Dy), and 5% terbium (Tb)) rod can be used to provide a variable, i.e., selectable, frequency in a broader band range by mechanical shearing.

Cavitating Oil-Water Emulsion

The use of cavitation or advanced cavitation energy, which can be created by sonic or ultrasonic waves, on oil emulsions results in separation at the molecular level. Cavitation typically involves the formation and quick collapse of numerous air or vapor pockets (or bubbles) in a liquid through the hydrodynamic generation of rapid and intense pressure changes. This may result from the movement of a solid body, such as a propeller blade or piston. Cavitation can also occur in a hydraulic system as a result of low fluid levels that draw air into the system, producing tiny bubbles that undergo explosive decompression at the pump outlet.

Breaking of emulsions through cavitation provides certain advantages over other methods. It appears that the oil-water interface is broken, as energy, which is preferably ultrasonic energy, agitates the water molecule. This molecular shearing effect aids in the coalescence of oil droplets separated from the water droplets and the ultimate breaking of the emulsion.

Desulfurization by Cavitation

In addition to emulsion breaking, cavitation-based ultrasonic energy is believed to activate the organo-sulfur and metallic compounds preferentially. To achieve removal of the sulfur and heavy metals, a catalytic material is contacted with the sulfur and heavy metal molecules, while cavitations and optional, external heat are applied. As the target compounds are in the petroleum stream, the petroleum stream is brought into contact with the catalytic material.

A particular preferred embodiment includes a mechanical filtration cavitation system, which induces cavitation by forcing high pressure fluid through a filtration media; however, those with skill in the art will recognize that various methods of cavitation can be employed within the scope of the invention.

In a preferred embodiment of the process of the invention, the crude oil to be upgraded is subjected to the mechanical filtration cavitation system and is subsequently further upgraded in high purity hydrogen. The various stages of the process of the present invention can be performed either in a batch-wise manner or in a continuous-flow operation. Continuous-flow operations are preferred. Furthermore, in an embodiment of the present invention, the cavitation exposure is performed in a flow through reactor.

The invention includes the use of well dispersed catalysts. Catalysts known in the art for hydrotreating and hydroreforming are appropriate, including supported Ni—MO and Co—Mo sulfided catalysts. The metal component of the hydrotreating catalyst may be selected from Groups VIA or Groups VIIIA (IUPAC group identifier) of the Periodic Table. The preferred metals include iron, nickel, cobalt, chromium, vanadium, molybdenum, tungsten, or a combination of metals such as nickel-molybdenum, cobalt-nickel-molybdenum, cobalt-molybdenum, nickel-tungsten, or nickel-tungsten-titanium. Generally, the metal component will be selected for good hydrogen transfer activity. Preferably, the catalyst is selected from the group consisting of Fe, Co, Mo, and Cd. In a preferred embodiment, a class of catalysts with high selectivity for middle distillates in less extreme operating conditions is used. Nanocatalysts are also preferred.

Furthermore, the process is conducted in an oxygen-free environment following appropriate safety procedures during the first stage of emulsion breaking. The crude oil must be processed in a substantially oxygen free environment.

In a preferred embodiment, high purity hydrogen is used to treat the materials during cavitation. U.S. Pat. No. 7,259,288, entitled "Enhanced Hydrogen Recovery for Hydroprocessing Units" discloses a process to create high purity hydrogen, and is incorporated herein by reference.

It is the purpose of the present invention to upgrade crude oil or fractions of crude oil, which can be in an emulsion form, by exposing the emulsion to cavitation in order to break the emulsion into an aqueous phase and an oil phase The organic phase is then recovered from the aqueous phase by conventional separation units and treated with catalyst and hydrogen and upgraded in a cavitation filtrations device, to form a mixed stream, which includes catalyst-sulfided particles and a product stream. The catalyst-sulfided particles are then separated from the mixed stream leaving the product stream The product stream has a reduced sulfur content and preserves the yield, chemical composition and motor fuel performance characteristics, e.g., octane, of the feed stream.

Regarding FIG. 1, crude oil feed enters mixer [10] via line [2] while the catalyst enters mixer [10] via line [4]. Mixer [10] disperses the catalyst throughout the crude oil feed to create a dispersion stream, which exits mixer [10] and enters filtration cavitation system [20] via line [12]. Filtration cavitation system [20] is comprised of cavitation reactor [18] and filter [19]. The dispersion stream undergoes cavitation and filtration in the presence of first hydrogen gas feed [14], which is preferably highly purified hydrogen gas, to produce a mixed stream.

The mixed stream exits filtration cavitation system [20] and enters separator [30] via line [22]. Separator [30] can be any suitable device known in the art for separating catalyst from a hydrocarbon product. The mixed stream is separated into spent catalyst stream [34] and product stream [32], the product stream having a substantially reduced sulfur content in comparison with the sulfur content of the crude oil feed.

Figure 2:
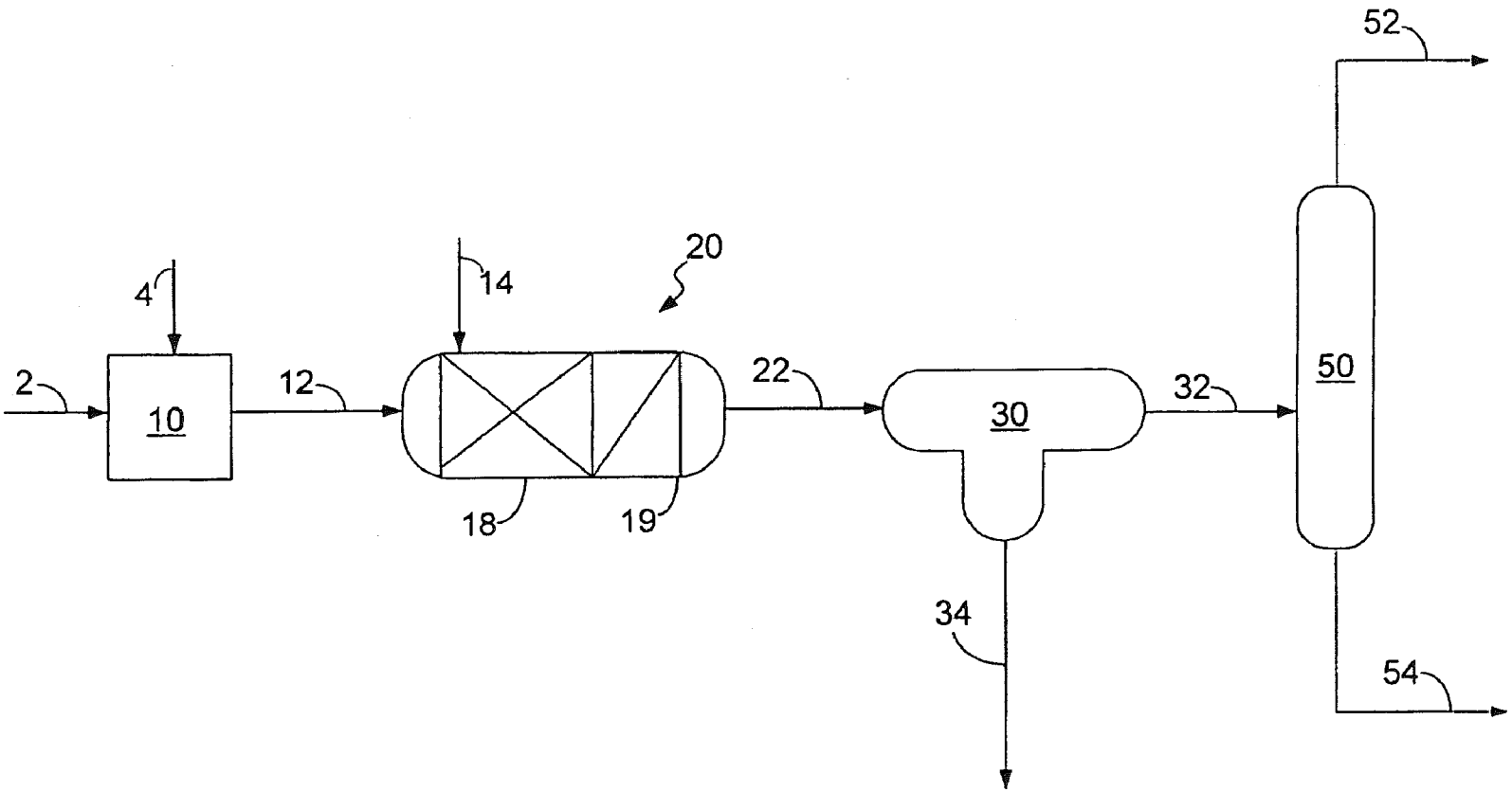
FIG. 2 shows an alternate embodiment of the invention.

In FIG. 2, the process is the same as the process of FIG. 1, with the addition of an additional separation step. Product stream [32] leaving separator [30] enters equilibrium separator [50] in order to remove gaseous sulfur products [52] from product stream [32] to produce usable product [54].

Figure 3:
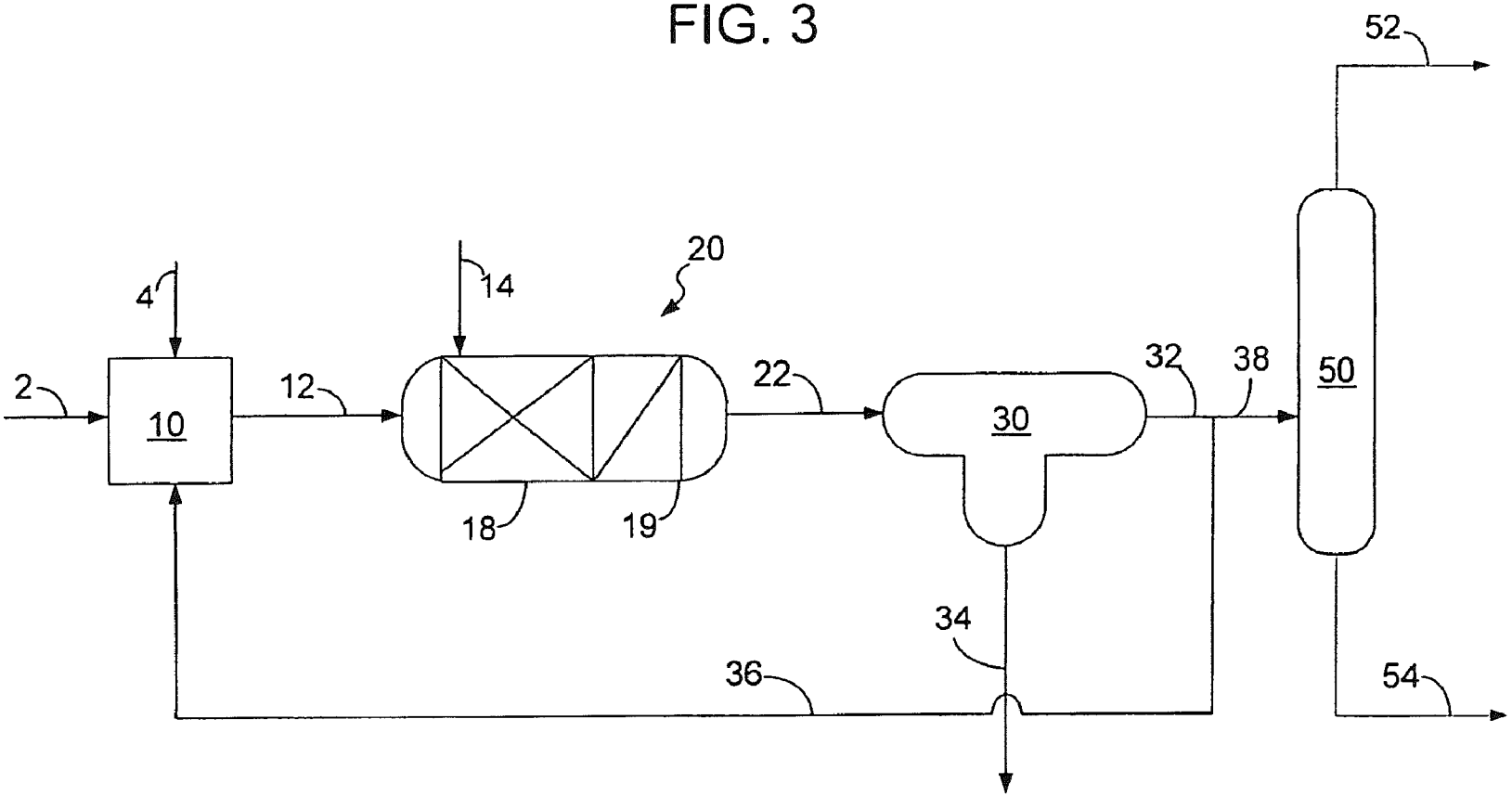
FIG. 3 shows an alternate embodiment of the invention.

In FIG. 3, the process is the same as the process of FIG. 2, except that product stream [32] is split into two streams: recycle stream [36] and improved product stream [38]. Improved product stream [38] is fed into equilibrium separator [50], while recycle stream [36] is returned to the process to mix with the dispersion stream so that it may subsequently reenter filtration cavitation system [20].

Figure 4:
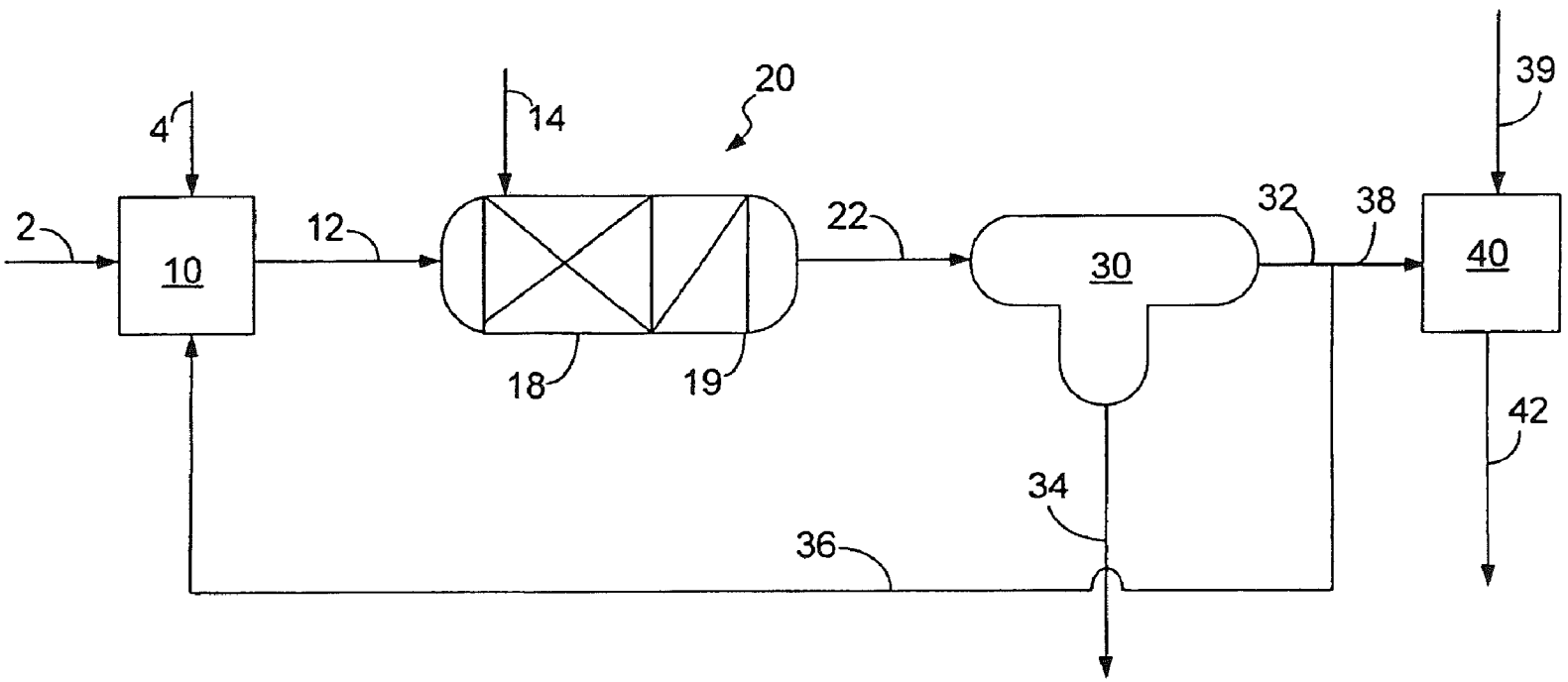
FIG. 4 shows an alternate embodiment of the invention.

In FIG. 4, crude oil feed enters mixer [10] via line [2] while the catalyst enters mixer [10] via line [4]. Mixer [10] disperses the catalyst throughout the crude oil feed to create a dispersion stream, which exits mixer [10] and enters filtration cavitation system [20] via line [12]. Filtration cavitation system [20] is comprised of cavitation reactor [18] and filter [19]. The dispersion stream undergoes cavitation and filtration in the presence of first hydrogen gas feed [14], which is preferably highly purified hydrogen gas, to produce a mixed stream. The mixed stream exits filtration cavitation system [20] and enters separator [30] via line [22]. Separator [30] can be any suitable device known in the art for separating catalyst from a hydrocarbon product. The mixed stream is separated into spent catalyst stream [34] and product stream [32]. Product stream [32] is split into two streams: recycle stream [36] and improved product stream [38]. Improved product stream [38] is fed into hydrotreater [40], while recycle stream [36] is returned to the process to mix with the dispersion stream so that it may subsequently reenter filtration cavitation system [20]. Second hydrogen gas feed [39] enters hydrotreater [40], wherein improved product stream [38] is hydrotreated to produce hydrotreated-product stream [42], wherein hydrotreated-product stream [42] has a substantially reduced sulfur content in comparison with the sulfur content of the crude oil feed.

Figure 5:
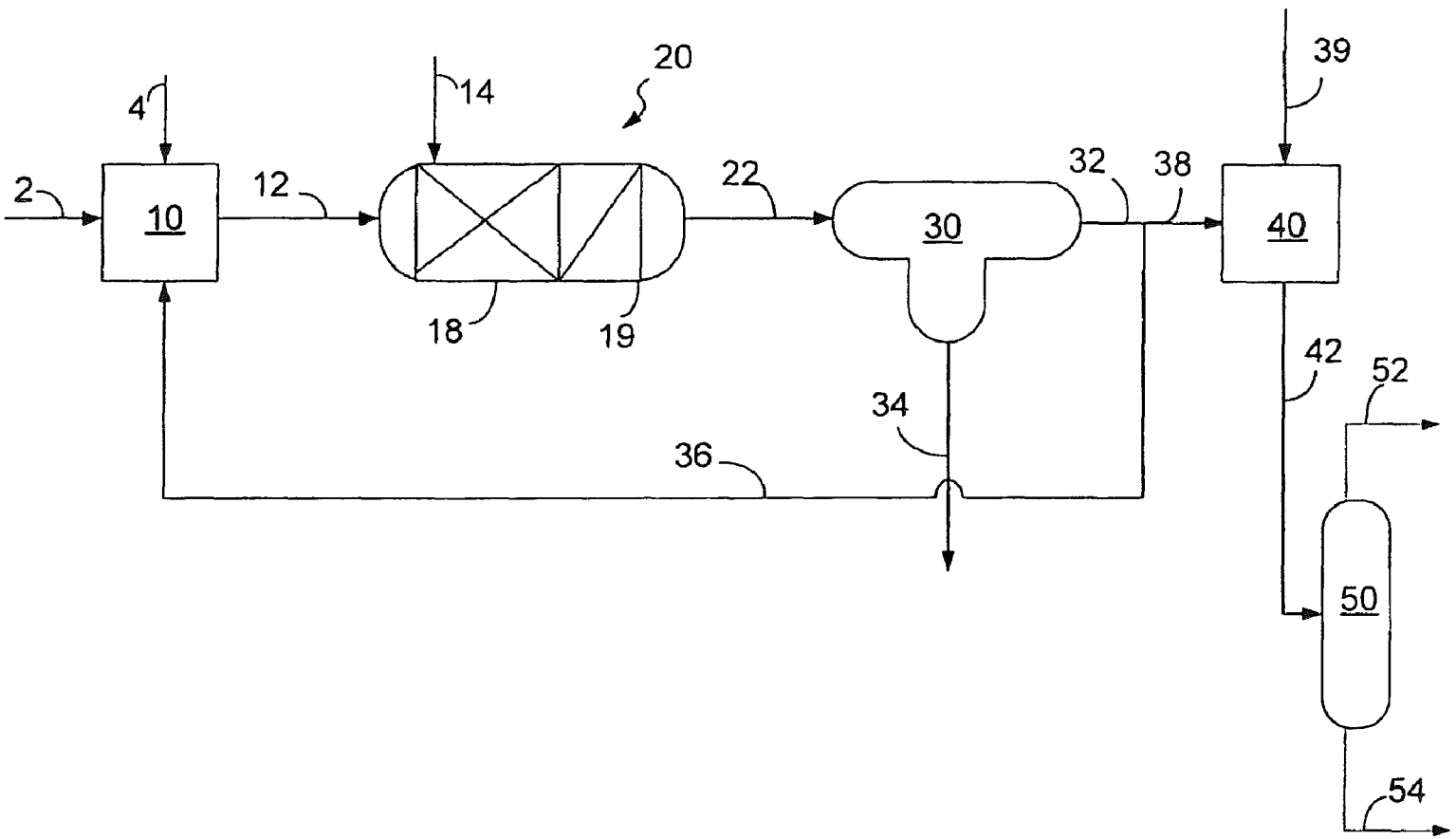
FIG. 5 shows an alternate embodiment of the invention.

In FIG. 5, the process is the same as the process described in FIG. 4, with the addition of feeding hydrotreated-product stream [42] to equilibrium separator [50], wherein gaseous sulfur products [52] are removed from hydrotreated-product stream [42] to produce usable product [54].

Figure 6:
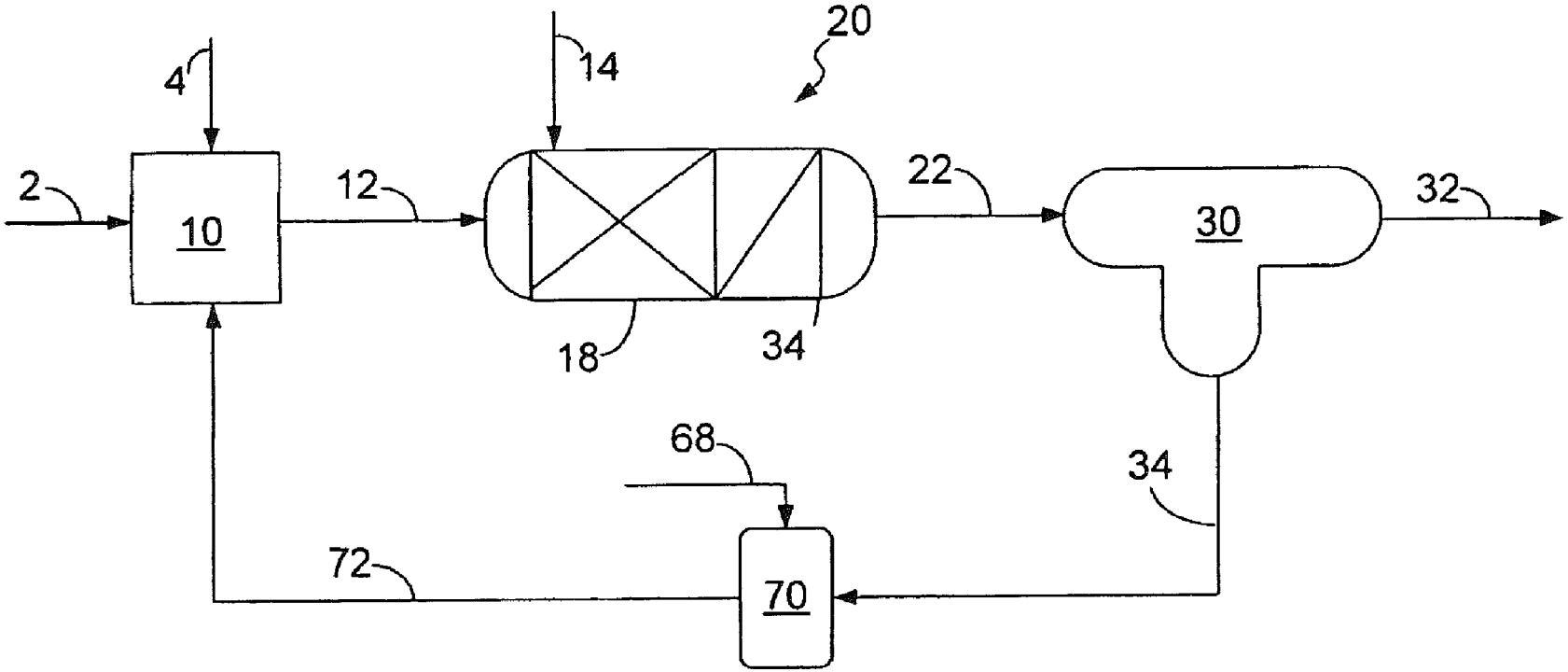
FIG. 6 shows an alternate embodiment of the invention.

In FIG. 6, the process is the same as the process described in FIG. 1, with the addition of feeding spent catalyst stream [34] to catalyst regeneration system [70]. A suitable gas stream is fed into catalyst regeneration system [70] via line [68]. Suitable gas streams are well known in the art, and the selection of a suitable gas stream would depend strongly on the type of catalyst or catalysts being used for treatment. The catalyst-sulfided particles within spent catalyst stream [34] are regenerated within catalyst regeneration system [70], to become reformed catalyst stream [72], which is subsequently returned to the process at mixer [10]. One of ordinary skill in the art will recognize acceptable regeneration methods.

Figure 7:
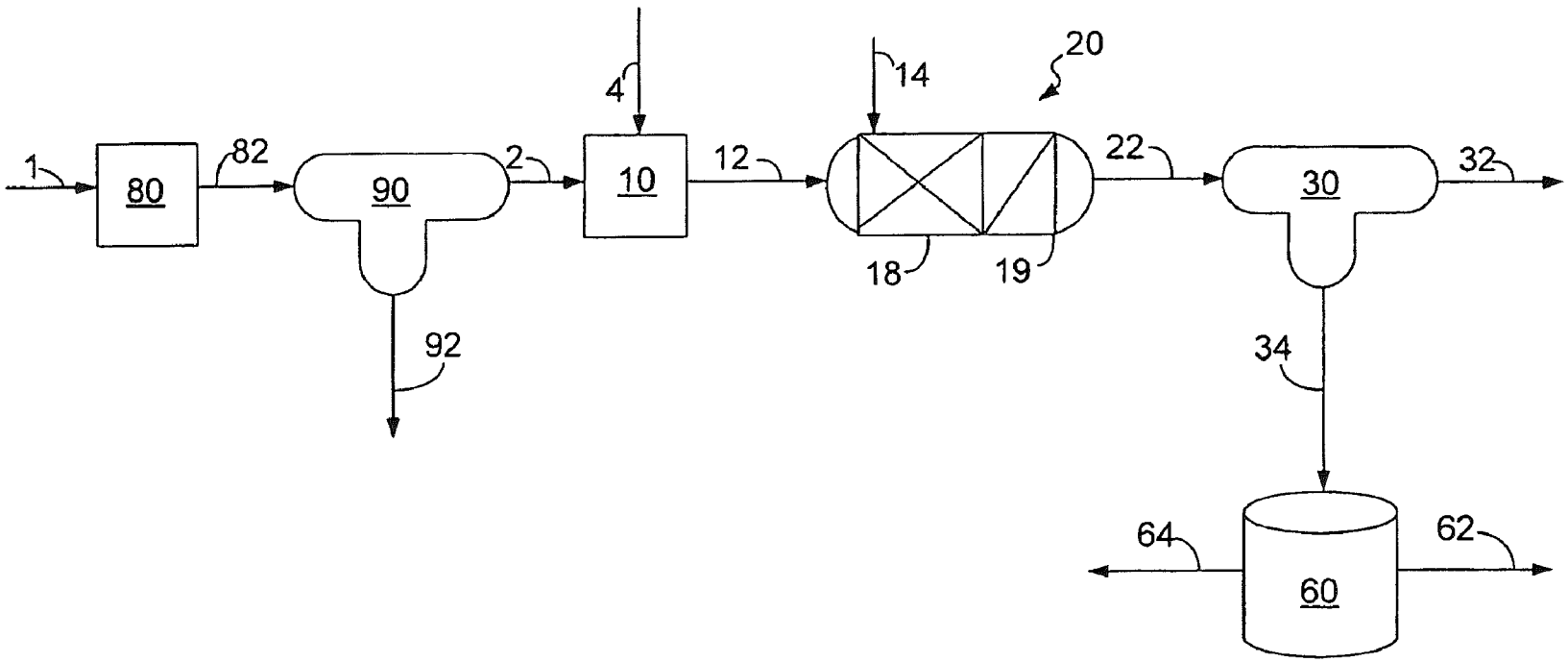
FIG. 7 shows an alternate embodiment of the invention.

FIG. 7 represents an embodiment in which a water-containing crude oil feed is treated by a process of the present invention. In this embodiment, the water-containing crude oil feed enters sonicator [80] via line [1], wherein the water-containing crude oil feed is subjected to sonications in an energy range sufficient to remove a substantial amount of water dissolved in an oil phase of the water-containing crude oil feed to an aqueous phase in the water-containing crude oil feed forming two-phase stream [82]. Two-phase stream [82] enters oil/water separator [90] wherein the water is removed via line [92], leaving behind the crude oil feed, which then enters mixer [10] via line [2].

The catalyst enters mixer [10] via line [4]. Mixer [10] disperses the catalyst throughout the crude oil feed to create a dispersion stream, which exits mixer [10] and enters filtration cavitation system [20] via line [12]. Filtration cavitation system [20] is comprised of cavitation reactor [18] and filter [19]. The dispersion stream undergoes cavitation and filtration in the presence of first hydrogen gas feed [14], which is preferably highly purified hydrogen gas, to produce a mixed stream. The mixed stream exits filtration cavitation system [20] and enters separator [30] via line [22]. Separator [30] can be any suitable device known in the art for separating catalyst from a hydrocarbon product. The mixed stream is separated into spent catalyst stream [34] and product stream [32], the product stream having a substantially reduced sulfur content in comparison with the sulfur content of the crude oil feed. Spent catalyst stream [34] then enters water/catalyst separator [60], wherein any excess water that was not removed via line [92] may be removed via line [62]. Additionally, water removed via line [62] is upgraded in that the water removed via line [62] has a reduced content of sulfur as compared to water-containing crude oil feed [1]. Dehydrated catalyst [64] may then be discarded or sent to a regeneration system and recycled back into the system [not shown].

Those skilled in the art will recognize that many changes and modifications may be made to the process without departing the scope and spirit of the invention. In the drawings and specification, there have been disclosed embodiments of the invention and, although specific terms are employed, they are used in a generic and descriptive sense only and not for the purpose of limitation, the scope of the invention being set forth in the following claims. The invention has been described in considerable detail with specific reference to these illustrated embodiments. It will be apparent, however, that various modifications and changes can be made within the spirit and scope of the invention as described in the foregoing specification.

What is claimed is:

1. A process for upgrading a water-containing crude oil comprising the steps of:

(a) sonicating the water-containing crude oil in an energy range sufficient to create an aqueous phase from water in the water-containing crude oil;

(b) removing substantially all of the aqueous phase from the water-containing crude oil in order to produce a crude oil feed;

(c) mixing the crude oil feed with a catalyst in a mixer to produce a dispersion stream, the dispersion stream being characterized by a dispersion of particles of the catalyst distributed substantially throughout the crude oil feed, the particles defining a particle size range;

(d) feeding the dispersion stream to a filtration cavitation system having a cavitation reactor and a filter;

(e) cavitating and filtering the dispersion stream in the presence of hydrogen gas to produce a mixed stream, (f) controlling cavitation pressure and cavitation temperature during the cavitating and filtering step such that the cavitation pressure is maintained substantially within a pre-defined pressure range and the cavitation temperature is maintained substantially within a pre-defined temperature range, the cavitating and filtering step being performed during a pre-determined residence time sufficient to reduce a substantial amount of sulfur in the crude oil;

(g) separating the mixed stream into a spent catalyst stream and a product stream, the spent catalyst stream comprising catalyst-sulfided particles, the product stream having a substantially reduced sulfur content in comparison with sulfur content of the crude oil feed;

(h) hydrotreating the product stream using hydrogen gas to produce a hydrotreated-product stream; and (i) feeding the hydrotreated-product stream to an equilibrium separator for separating gaseous sulfur products from the hydrotreated-product stream to produce a usable product.

2. The process of claim 1 further comprising the steps of:

splitting the product stream in step (g) into a recycle stream and an improved product stream;

returning the recycle stream to mix with the dispersion stream and enter the filtration cavitation system; and hydrotreating in step (h) the improved product steam instead of the product stream.

3. The process of claim 1 further comprising the steps of:

regenerating the catalyst-sulfided particles to form a reformed catalyst stream; and returning the reformed catalyst stream to the process at a point upstream the cavitation reactor.

4. The process of claim 1 where cavitation is induced in the filtration cavitation system using transducers.

5. The process of claim 1 where cavitation is induced by applying cavitation vibration to the dispersion stream, the cavitation vibration having a frequency in the range of about 1Hz to about 20kHz.

6. The process of claim 1 where the catalyst includes a metal selected from the group consisting of Group VIA of the periodic table, Group VIIIA of the periodic table, and combinations thereof.

7. The process of claim 1 where the catalyst includes metals selected from the group consisting of iron, nickel, cobalt, chromium, vanadium, molybdenum, tungsten and combinations thereof.

8. The process of claim 1 where the catalyst includes elements selected from the group consisting of Fe, Mo, Co, Cd and combinations of thereof.

9. The process of claim 1 where the catalyst is a nanocatalyst.

10. The process of claim 1 further comprising the step of feeding the product stream to a fluid catalytic cracker to increase olefins as compared to the product stream.

11. The process of claim 1 where the pre-defined temperature range is about 40° C. to about 250° C.

12. The process of claim 1 where the pre-defined residence time is in the range of about 3 seconds to about 2 hours.

13. The process of claim 1 further comprising the step of adding a solvent to the crude oil feed prior to the step of cavitating and filtering the dispersion stream.

14. The process of claim 1 where the pre-defined pressure range is about 100psi to about 1000psi.

15. The process of claim 1 further comprising the step of delivering cavitation energy to a treatment volume, the treatment volume being comprised of an emulsion, the emulsion being comprised of a hydrocarbon and a substrate, such that the cavitation energy facilitates demulsification of the hydrocarbon from the substrate.

16. The process of claim 15 where the process is conducted in the absence of a demulsifying chemical.

17. The process of claim 15 where the treatment volume is located below ground.

18. The process of claim 1 where the energy range sufficient to remove a substantial amount of water dissolved in an oil phase of the water-containing crude oil feed to an aqueous phase in the water-containing crude oil feed is in the range of about 20 to about 250watts/cm$^2$.

19. The process of claim 1 where the aqueous phase is characterized by a lower content of sulfur as compared to the water-containing crude oil feed.

20. The process of claim 1 further comprising the step of subjecting the water-containing crude oil to sonic energy at a frequency that is in the range of about 400Hz to about 10kHz in the presence of a metal hydrogenation catalyst while the water-containing crude oil is being produced in a production well, where water contained within the crude oil feed reacts to form hydrogen, the hydrogen operable to hydrotreat and upgrade the water-containing crude oil during production.

21. The process of claim 1 further comprising the steps of:

contacting the water-containing crude oil while the water-containing crude oil is down hole with a chemical compound that is selected from the group consisting of ammonia, hydrazine, formic acid and combinations thereof; and subjecting the water-containing crude oil to sonic energy at a frequency that is in the range of about 400Hz to about 10kHz in the presence of a metal hydrogenation catalyst while the water-containing crude oil is being produced in a production well, whereby the chemical compound contacting the crude oil feed reacts to form hydrogen, the hydrogen operable to hydrotreat and upgrade the water-containing crude oil during production.

22. The process of claim 21, wherein the metal hydrogenation catalyst is selected from the group consisting of nickel on zinc dust, platinum on carbon, and palladium on carbon.

* * * * *